US006929843B2

(12) United States Patent
Kuchar

(10) Patent No.: US 6,929,843 B2
(45) Date of Patent: Aug. 16, 2005

(54) FENCE TAPE

(76) Inventor: David M. Kuchar, 239 Main St., Metuchen, NJ (US) 08840-2727

( * ) Notice: Subject to any disclaimer, the term of this patent is extended or adjusted under 35 U.S.C. 154(b) by 0 days.

(21) Appl. No.: 10/605,028

(22) Filed: Sep. 2, 2003

(65) Prior Publication Data

US 2005/0048258 A1 Mar. 3, 2005

(51) Int. Cl.[7] ..... B32B 3/10; B32B 3/24

(52) U.S. Cl. ..... 428/136; 428/135; 428/131; 428/43; 428/596; 256/1; 256/19; 256/21

(58) Field of Search ..... 428/136, 131, 428/135, 43, 596; 256/1, 19, 21

(56) References Cited

U.S. PATENT DOCUMENTS

| | | | | |
|---|---|---|---|---|
| 347,324 | A | 8/1886 | Cramer | |
| 1,895,642 | A | 1/1933 | Preble | |
| 2,037,164 | A | 4/1936 | Harrah | |
| 2,319,225 | A | 5/1943 | Grebe et al. | |
| 2,493,726 | A | 1/1950 | O'Day | |
| 2,558,185 | A | 6/1951 | Leisen | |
| 2,602,521 | A | 7/1952 | Smith | |
| 2,989,145 | A | 6/1961 | Goodloe | |
| 3,040,968 | A | 6/1962 | Long et al. | |
| 3,067,039 | A | 12/1962 | Crane | |
| 3,069,067 | A | 12/1962 | Crane | |
| 3,080,579 | A | 3/1963 | Gordon | |
| 3,109,579 | A | 11/1963 | Crane | |
| 3,245,606 | A | 4/1966 | Crane | |
| 3,346,246 | A | 10/1967 | Loetel et al. | |
| 3,407,550 | A | 10/1968 | Shaw | |
| 3,550,842 | A | 12/1970 | Scholz | 229/87 |
| 3,603,369 | A | 9/1971 | Scholz | 150/52 R |
| 3,655,501 | A | 4/1972 | Tesch | 161/109 |
| 3,744,222 | A | 7/1973 | Delso | 55/446 |
| 3,762,629 | A | 10/1973 | Bruno | 229/87 F |
| 3,825,465 | A | 7/1974 | Stock | 161/112 |
| 3,839,525 | A | 10/1974 | Doll | 264/154 |
| 3,958,751 | A | 5/1976 | Bruno | 229/87 F |
| 3,966,044 | A | 6/1976 | Cunningham | 206/427 |
| 4,136,771 | A | 1/1979 | Owen | 206/150 |
| 4,170,691 | A | 10/1979 | Rogers | 428/572 |
| 4,306,675 | A | 12/1981 | Swanson | 229/42 |
| 4,501,707 | A | 2/1985 | Buhlmann | 261/94 |
| 4,997,721 | A | 3/1991 | Shaw et al. | 428/577 |
| 5,244,715 | A | 9/1993 | Kuchar | 428/195 |
| 5,252,111 | A | 10/1993 | Spencer | 55/489 |
| 5,500,271 | A | 3/1996 | Pasch et al. | 428/135 |
| 5,691,032 | A | 11/1997 | Trueblood et al. | 428/136 |

FOREIGN PATENT DOCUMENTS

AU 199226388 A1 * 11/1991

* cited by examiner

*Primary Examiner*—William P. Watkins, III
(74) *Attorney, Agent, or Firm*—Stanley H. Kremen

(57) ABSTRACT

A tape barrier consisting of flexible material, has generally parallel edges and substantially greater length than width. Cuts are made into the tape at intervals along the tape forming slits that define cross members that extend generally along the length of the tape. The slits may be completed cuts so that the cross members are free to fall away from the tape or perforations that enable the cross members to be separated from the tape by tearing along the perforations. When the tape is deployed generally horizontally, the cross members will fall vertically so as to provide cross members along the length of the resulting tape structure.

15 Claims, 2 Drawing Sheets

40
18

50
44
45
42

FENCE TAPE

CROSS REFERENCE TO RELATED APPLICATIONS

The present invention is related to my U.S. Pat. No. 5,244,715, entitled FLAG STRIP, the complete text of which is incorporated in its entirety by reference herein. Much of this material was disclosed in U.S. Provisional Patent Application No. 60/083,183, entitled FENCE TAPE, filed Apr. 27, 1998, now abandoned, and in its U.S. Non-Provisional counterpart application Ser. No. 09/300,771, entitled FENCE TAPE, also now abandoned. The complete text of said provisional and non-provisional applications are also incorporated in their entireties by reference herein.

BACKGROUND OF INVENTION

1. Field of the Invention

The present invention is an improvement over ribbons or strips used to mark off work or hazardous areas. More specifically the present invention provides for a fence type barrier to be formed by portions of the ribbon or strip.

2. Summary of the Prior Art

Tapes, ribbons or strips, usually of highly flexible resinous material, are commonly used between elevated supports to prevent pedestrians or vehicles from entering hazardous areas. Often, the tape material is brightly colored, frequently yellow or orange, and may additionally have some sort of cautionary message printed on the tape in contrasting colors, such as black. Frequently the word "caution" is repeated along the ribbon, for example. Thus, when the ribbon or tape serves as a barrier, its bright color allows it to be seen more readily, and the written message warns people not to enter the area beyond or to proceed cautiously. This type of tape or ribbon is very popular because it is easy to handle and can be tied between most permanent or temporary structures.

Partially rigid plastic fence material is also commonly used for the same purpose. The fence material consists of a lattice of plastic with regularly spaced voids. This material is often purchased in rolls, having a pre-specified width. This width defines the height of the fence. The material is unrolled and cut to a desired length. The fence material is then tied to elevated support structures to create the barrier. Often the plastic material is brightly colored, usually orange for example. The fence does not inherently supply a cautionary message since the plastic lattice members are too small to support a meaningful visual display.

No product currently exists that produces a fence barrier that expands from a roll of flexible tape, ribbon, or strip. The prior art comprises products that expand to produce lattice structures. Most of these are inappropriate for use as a fence barrier. Many produce rigid lattice structures. Examples of these are shipping trays, sun screens, bird repellents, air cleaners, and filter units. Others produce flexible lattice structures. One example is a slitted wrapper for packaged produce. Another example is the sheet material described in Guenther Horst Tesch's U.S. Pat. No. 3,655,501 entitled FLEXIBLE MATERIALS, and patented on Apr. 11, 1972. Tesch requires at least one non-slip or adhesive surface, without which the expandable/expanded sheet is useless. Also, Tesch requires both faces of the material in use to be covered. All of the flexible lattice structures are produced on sheets of flexible materials that have been pre-cut to a specific size. No currently available product is created as a tape roll of undetermined length or a web which, once unrolled and tied to elevated structures separated by any reasonable distance, can be further expanded by the additional step of pulling the tape in the width direction, thereby forming a lattice or fence.

SUMMARY OF INVENTION

The present invention provides a single composite web structure in the form of a flexible tape or ribbon which may be brightly colored and marked with "caution" or other words or symbols to visually give a warning. However, in addition, it provides integral cross members that are supported from the tape when the tape is held generally horizontally in place. The cross members are integral and are formed from the same tape. The cross members may be full or continuous cuts when the ribbon or tape is manufactured. However, the cross members are preferably formed by perforated cuts. This tape can be used alternately in conventional fashion or torn along the perforations to form the integral cross members. The cross members may be cut in various shapes, either uniform or variable, along the length of the ribbon and may be all of the same type or size or may be of different types or sizes. Additionally, holes may be punched at the ends of cut or perforated cut lines and may help to quickly identify the tear line and also to help confine the tears to the perforated areas. Additional holes within the web of the tape from which the cross members are cut may help to determine the fold line along which the cross member folds within the ribbon's web.

More specifically, the present invention concerns a tape barrier display or warning in which a tape or web of flexible material having generally parallel edges and substantially greater length than width is employed. Cuts are made into the tape at selected intervals to form slits along the tape defining cross members that extend generally along the length of the tape. The cuts may be completed slits so that the cross members are free to fall away from the tape. More frequently, it is anticipated the slits will be perforations that enable the cross members to be separated from the tape by tearing along the perforations. When the tape is deployed generally horizontally the cross members will fall vertically so as to provide cross members along the length of the resulting tape structure. Metallic or other substances can be added through any other means such as vapor deposition, lamination, printing, printing of conductive inks, or co-extruded particulate matter to make the tape readily detectable, or carry electrical currents. An application that would use this feature would be where the fencing material is buried underground. Such materials could be easily detected from the surface. In addition, the ability to conduct electricity could permit the fencing material to act as a heating element that melts snow on driveways or pavements.

BRIEF DESCRIPTION OF DRAWINGS

For a better understanding of the invention, reference is made to the following drawings in which.

DETAILED DESCRIPTION

The invention is comprised of a flexible web material, typically of plastic such as polyethylene or vinyl, which is slit or die cut to allow the material to be deformed into a fencelike structure.

Figure 1:
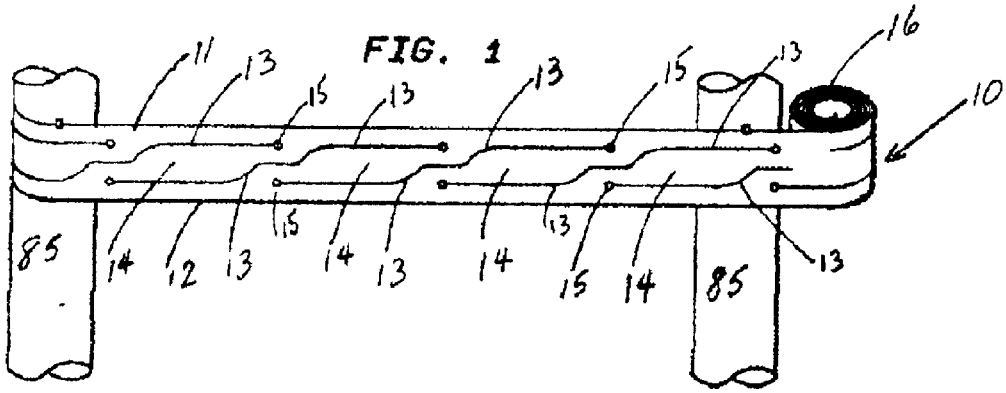
FIG. 1 shows an embodiment of the invention supported between a pair of vertical posts.

FIG. 1 shows the converted flexible web material 10 having a top edge 11 and bottom edge 12 with internal die cuts 13 defining undeployed cross members 14. Punched holes 15 act against stress concentration at the ends of the die cuts. Material 10 is attached, preferably by tying, although any means of attachment such as staples or tape may be used, to preferably vertical posts 85. The unused portion of the material 10, still rolled, is shown as 16.

Figure 2:
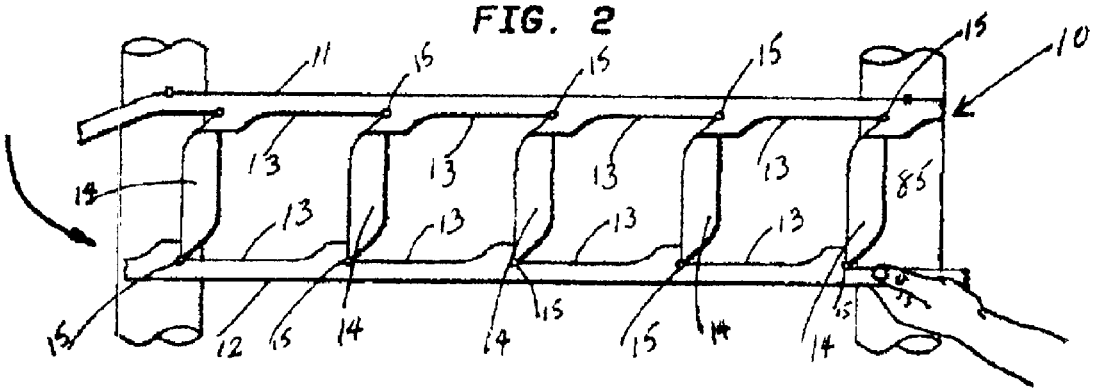
FIG. 2 shows the embodiment of FIG. 1 after deployment of cross members.

FIG. 2 shows the converted flexible web material 10 attached to posts 85 at the top edge 11. The bottom edge 12 is pulled to the right and downward, causing die cuts 13 to open so that cross members 14 are deployed generally vertically to result in a fence like structure.

Figure 3:
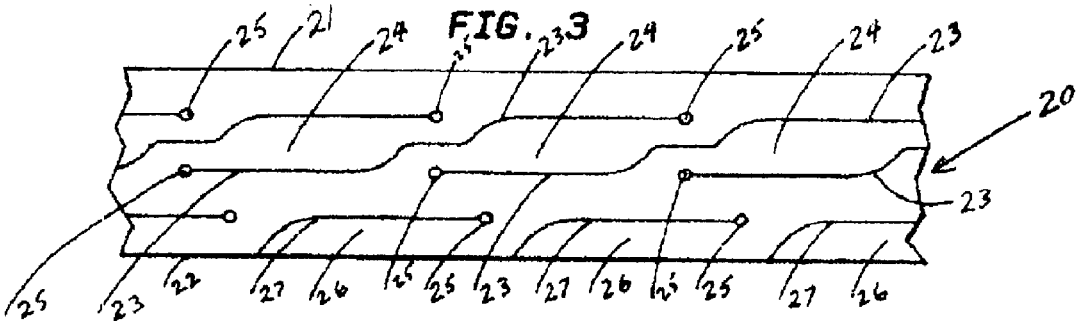
FIG. 3 shows an alternate embodiment of the invention with integral flags.

The embodiment of FIG. 3 works similarly to that of FIGS. 1 and 2, but additionally includes die cuts 27 defining deployable flags 26 along bottom edge 22 of converted web material 20. Operation of the deployable flags is described in my U.S. Pat. No. 5,244,715 which is incorporated herein by reference. Top edge 21, bottom edge 22, die cuts 23, cross members 24, and holes 25 are equivalent to elements 11, 12, 13, 14, and 15 respectively of FIGS. 1 and 2.

Figure 4:
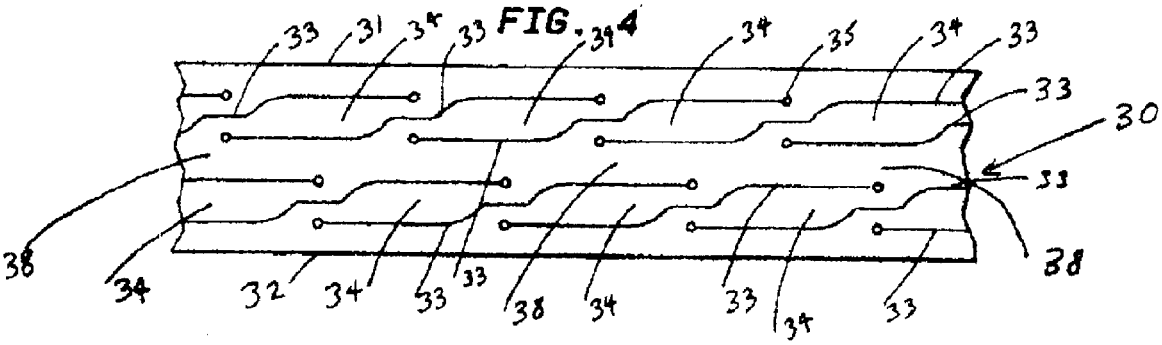
FIG. 4 shows another alternate embodiment of the invention with a double row of cross members.

The embodiment of FIG. 4 has top edge 31, bottom edge 32, die cuts 33, cross members 34, and holes 35 equivalent to elements 11, 12, 13, 14, and 15 respectively of FIGS. 1 and 2. In this embodiment, the converted web material 30 includes two rows of deployable cross members 34, which, when the tape is deployed in the manner shown in FIG. 2, results in a fence structure having not only top and bottom edge members, but a center rail 38.

Figure 5:
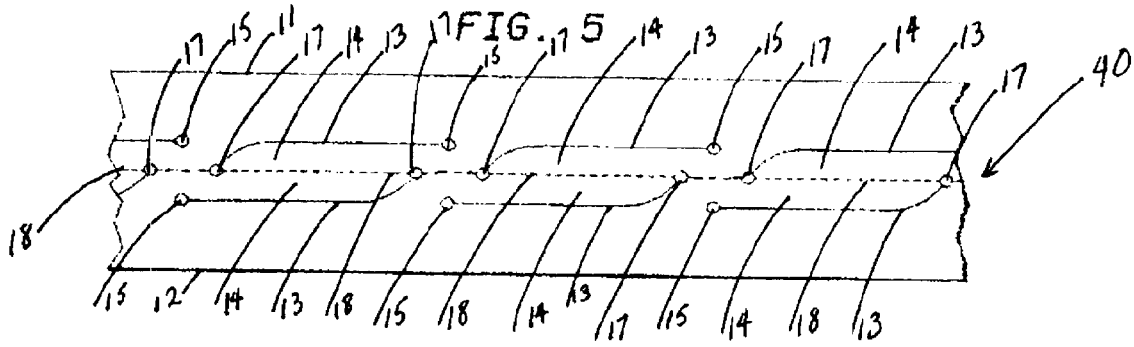
FIG. 5 shows yet another alternate embodiment of the invention which can be converted to two tapes having integral flags.

The embodiment of FIG. 5 is identical to that of FIG. 1 with the addition of perforated lines 18 and their associated stress relief holes 17. The converted web material 40, by separating at perforated lines 18, can be transformed from a fencelike structure into two strips of tape having deployable flags as described in my U.S. Pat. No. 5,244,715.

Figure 6:
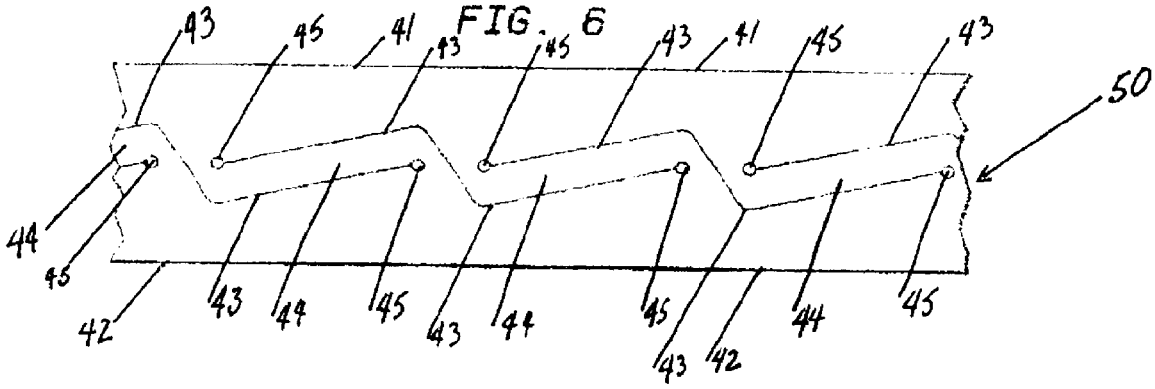
FIG. 6 shows yet another alternate embodiment of the invention.

The embodiment of FIG. 6 is a variation on the embodiment shown in FIG. 1 to demonstrate some of the variability possible within the invention. Converted web material 50 has all the elements of converted web material 10; top edge 41, bottom edge 42, die cuts 43, cross members 44, and holes 45 are equivalent to elements 11, 12, 13, 14, and 15 respectively.

Any of the cut lines in any of the embodiments may be made as a series of perforations in order to make more manageable the handling of the tape prior to deployment of the cross members and flags.

The present invention has been described in terms of specific embodiments. Other embodiments will occur to those skilled in the art. All such variations and modifications of the invention within the scope of the claims are intended to be within the scope and spirit of the present invention.

I claim the following:

1. A flexible web barrier having generally parallel edges, having substantially greater length than width, and capable of being rolled longitudinally, wherein:

(a) the web is cut longitudinally to form slits at intervals, the slits defining linear members comprising at least a top strand and a bottom strand and a plurality of cross members; and, (b) displacing the bottom strand longitudinally relative to the top strand deploys the cross members so as to increase the width of the barrier, leaving regular voids and further wherein said flexible web barrier has top and bottom longitudinal edges, and before deployment of said cross members, a plurality of said cut slits are adjacent each other in the longitudinal direction, each of said adjacent slits being nonlinear and having top and bottom portions, wherein said top portion of each slit of said plurality of slits overlies said bottom portion of an adjacent slit of said plurality of slits, wherein said overlying top and bottom portions of adjacent slits define said plurality of cross members.

2. The barrier of claim 1 wherein the slits are continuous.

3. The barrier of claim 1 wherein the slits are series of perforations.

4. The barrier of claim 3 wherein the perforations are irregular.

5. The barrier of claim 1 also comprising a coating.

6. The barrier of claim 5 wherein the coating is continuous.

7. The barrier of claim 5 wherein the coating is intermittent.

8. The barrier of claim 1 also comprising a readily detectable substance.

9. The barrier of claim 5 also comprising a readily detectable substance.

10. The barrier of claim 8 wherein the detectable substance is metallic.

11. The barrier of claim 9 wherein the detectable substance is metallic.

12. The barrier of claim 1 wherein the web is electrically conductive.

13. The barrier of claim 5 wherein the coating is electrically conductive.

14. The barrier of claim 1 also comprising integral flags.

15. The barrier of claim 1 configured to separate into at least two tapes comprising integral flags.

* * * * *